US011708639B2

(12) United States Patent
Choi et al.

(10) Patent No.: US 11,708,639 B2
(45) Date of Patent: Jul. 25, 2023

(54) ELECTROCHEMICAL OXIDATION OF 5-HYDROXYMETHYLFURFURAL USING COPPER-BASED ANODES

(71) Applicant: Wisconsin Alumni Research Foundation, Madison, WI (US)

(72) Inventors: Kyoung-Shin Choi, Fitchburg, WI (US); Dohwan Nam, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 530 days.

(21) Appl. No.: 16/854,037

(22) Filed: Apr. 21, 2020

(65) Prior Publication Data

US 2020/0248322 A1 Aug. 6, 2020

Related U.S. Application Data

(63) Continuation of application No. 15/695,619, filed on Sep. 5, 2017, now Pat. No. 10,669,639.

(51) Int. Cl.

| | |
|---|---|
| ***C25B 11/057*** | (2021.01) |
| ***C25B 11/04*** | (2021.01) |
| ***C25B 9/17*** | (2021.01) |
| ***C25B 11/031*** | (2021.01) |
| ***C25B 11/051*** | (2021.01) |
| ***C25B 11/061*** | (2021.01) |
| ***C25B 11/077*** | (2021.01) |
| ***C25B 3/23*** | (2021.01) |

(52) U.S. Cl.

CPC ..... *C25B 11/057* (2021.01); *C25B 3/23* (2021.01); *C25B 9/17* (2021.01); *C25B 11/031* (2021.01); *C25B 11/04* (2013.01); *C25B 11/051* (2021.01); *C25B 11/061* (2021.01); *C25B 11/077* (2021.01)

(58) Field of Classification Search

CPC ..... C25B 3/23; C25B 9/17–9/23; C25B 11/00–11/097

See application file for complete search history.

(56) References Cited

U.S. PATENT DOCUMENTS

2020/0055832 A1 2/2020 Crockatt et al.
2020/0255960 A1 8/2020 Choi et al.

OTHER PUBLICATIONS

Jiang et al ("Integrating Electrocatalytic 5-Hydroxymethylfurfural Oxidation and Hydrogen Production via Co-P-Derived Electrocatalysts", ACS Energy Letters, Jul. 2016, 1, 2, 386-390). (Year: 2016).*

Vuyyuru et al ("Oxidation of biomass derived 5-hydroxymethylfurfural using heterogeneous and electrochemical catalysis", Catalysis Today, 195, 2012, pp. 144-154). (Year: 2012).*

* cited by examiner

*Primary Examiner* — Alexander W Keeling
(74) *Attorney, Agent, or Firm* — Bell & Manning, LLC

(57) ABSTRACT

Electrochemical cells for the oxidation of 5-hydroxymethylfurfural are provided. Also provided are methods of using the cells to carry out the oxidation reactions. The electrochemical cells and methods use catalytic copper-based anodes to carry out the electrochemical oxidation reactions.

12 Claims, 13 Drawing Sheets

ELECTROCHEMICAL OXIDATION OF 5-HYDROXYMETHYLFURFURAL USING COPPER-BASED ANODES

CROSS REFERENCE TO RELATED APPLICATIONS

The present application is a continuation of U.S. patent application Ser. No. 15/695,619 that was filed Sep. 5, 2017, the entire contents of which are incorporated herein by reference.

BACKGROUND

Biomass is an accessible and renewable non-fossil-based carbon source that can offer a sustainable alternative to existing fossil fuel-derived transportation fuels and organic molecules. Among the various platform chemicals that can be obtained from biomass conversion, 2,5-furandicarboxylic acid (FDCA) is a key near-market platform chemical that can potentially replace terephthalic acid in many polyesters such as polyethylene terephthalate (PET). FDCA can also serve as an intermediate to other important polymers, fine chemicals, pharmaceuticals, and agrochemicals.

Few studies on the electrochemical oxidation of 5-hydroxymethylfurfural (HMF) using catalytic anodes have been published. Initial studies used noble metals or noble metal alloys (Pt, Au/C, Pd/C, $Pd_2Au/C$, $PdAu_2/C$) as catalytic anodes. (See, D. J. Chadderdon et al., *Green Chem.,* 2014, 16, 3778-3786; and K. R. Vuyyuru et al., *Catal. Today,* 2012, 195, 144-154.) The highest yield obtained for HMF conversion to FDCA was 83% achieved in a pH 13 solution using black carbon supported $PdAu_2$ alloy nanoparticle electrodes. Sun and co-workers reported several non-noble metal-containing heterogeneous catalytic electrodes (CoPi, $Ni_2P$, $Ni_3S_2$, and Ni) that can achieve >~90% yield for FDCA in a pH 14 solution. (See, N. Jiang et al., *ACS Energy Lett.* 2016, 1, 386-390; B. You et al., *Angew. Chem. Int. Ed,* 2016, 55, 9913-9917; B. You et al., *J. Am. Chem. Soc.,* 2016, 138, 13639-13646; and B. You et al., *ACS Catal.,* 2017, 7, 4564-4570.) The kinetics of HMF oxidation increase considerably as pH increases and, as a result, high rates and yields for FDCA production can be achieved at pH 14. However, the stability of HMF decreases substantially as pH increases due to the base-induced polymerization of HMF, which forms insoluble humins. (See, H. A. Rass et al., *Chem Sus Chem,* 2015, 8, 1206-1217.)

SUMMARY

Methods for carrying out the electrochemical oxidation of aromatic alcohols, such as HMF, are provided. Also provided are electrochemical cells used to carry out the oxidation reactions.

One embodiment of an electrochemical cell comprises: an anode in an anode electrolyte solution; and a cathode in a cathode electrolyte solution, wherein the anode comprises copper and the anode electrolyte solution comprises 5-hydroxymethylfurfural.

Using the electrochemical cell, 5-hydroxymethylfurfural can be oxidized by applying an anode potential to the anode that induces the electrochemical oxidation of the 5-hydroxymethylfurfural. If the anode electrolyte solution is an oxygen donating solution, the 5-hydroxymethylfurfural can be oxidized to 2,5-furandicarboxylic acid. The 2,5-furandicarboxylic acid can be formed at a yield of at least 75%. The 2,5-furandicarboxylic acid can be produced with a Faradaic efficiency of at least 75%.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Electrochemical cells (ECs) for the oxidation of aromatic alcohols are provided. Also provided are methods of using the cells to carry out the oxidation reactions. The cells and methods use copper-based anodes to oxidize the aromatic alcohols. The oxidations may be conducted in aqueous media at ambient temperatures and pressures (e.g., about 23° C. and about 1 atm) and do not require the use of precious metal catalyst electrodes.

Another aspect of the invention provides electrochemical cells for the oxidation of furfural. Also provided are methods of using the cells to carry out the oxidation reactions. The furfural can be oxidized to furan carboxylic acids. The cells and methods use copper-based anodes to oxidize the furfural. The oxidations may be conducted in aqueous media at ambient temperatures and pressures (e.g., about 23° C. and about 1 atm) and do not require the use of precious metal catalyst electrodes.

The aromatic alcohols, have an aromatic ring and at least one alcohol (—OH) group. The aromatic alcohols can further include one or more aldehyde groups. The aromatic rings of the aromatic alcohols can be homoaromatic or heteroaromatic ring. Other types of functional groups may also be present on the aromatic ring—in addition to alcohol and aldehyde groups. If the oxidation is carried out in an electrolyte solution that serves as an oxygen donor, such as in an aqueous electrolyte solution, the alcohol group can be oxidized to a carboxylic acid group. Aldehyde groups, if present, can also be oxidized to carboxylic acid groups in an oxygen-donating electrolyte solution. Thus, aromatic alcohols that have both an alcohol group and an aldehyde group, can be oxidized to aromatic dicarboxylic acids in an electron-donating electrolyte solution. Alternatively, if the anode reaction is carried out in an electrolyte solution that does not serve as an oxygen donor, such as acetonitrile, the oxidation reaction can be arrested prior to the conversion of the alcohol group to a carboxylic acid group. For example, the alcohol group can be converted to an aldehyde group instead.

Figure 1:
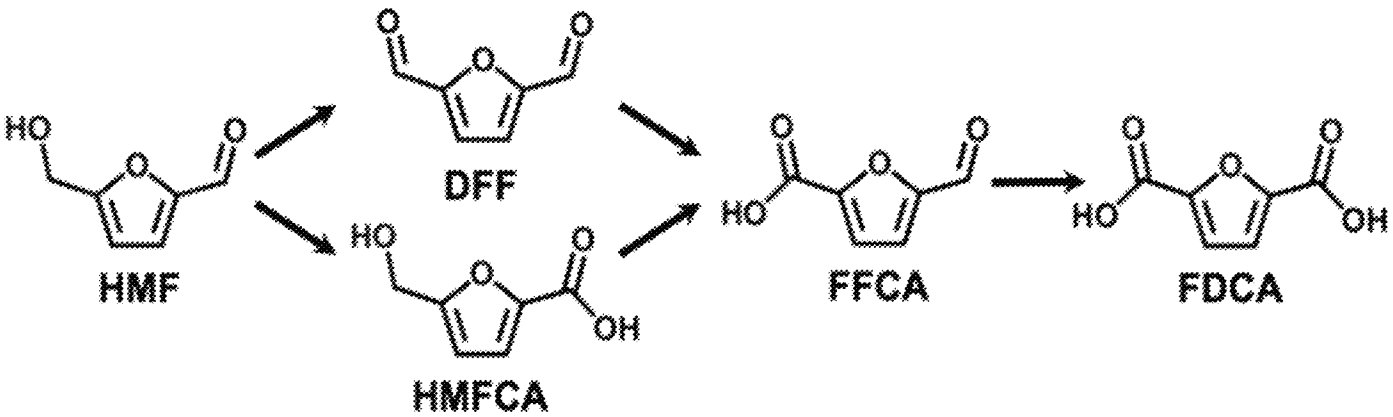
FIG. 1 shows two possible HMF oxidation pathways to FDCA.

HMF, a common biomass-derived intermediate, is one example of an aromatic alcohol having both an alcohol group and an aldehyde group in its aromatic ring. Using the present methods, HMF can be oxidized to the aromatic dicarboxylic acid, FDCA, in an oxygen-donating electrolyte solution. The oxidation of HMF to FDCA is shown in FIG. 1, Scheme 1. Two possible pathways to form FDCA are shown in Scheme 1. One pathway forms diformylfuran (DFF) as the first intermediate by the oxidation of the alcohol group of HMF, while the other pathway forms 5-hydroxymethyl-2-furancarboxylic acid (HMFCA) as the first intermediate by the oxidation of the aldehyde group of HMF. In an anode electrolyte that serves as an oxygen donor, both DFF and HMFCA are further oxidized to form 5-formyl-2-furancarboxylic acid (FFCA) and then FDCA. However, if the anode reaction is carried out in an electrolyte solution that does not serve as an oxygen donor, such as acetonitrile, the oxidation reaction can be arrested at the DFF intermediate to provide DFF as a product in high yields.

Among the various approaches used to oxidize HMF to FDCA, electrochemical oxidation of HMF in aqueous media can provide several distinct advantages. First, as the oxidation is driven by the electrochemical potential applied to the electrode, the use of chemical oxidants that may be environmentally harmful can be completely eliminated. Since water serves as an oxygen donor for the formation of the carboxylic acid groups from the alcohol and aldehyde groups, no chemicals other than HMF and water are necessary to form FDCA. Second, electrochemical oxidation can be effectively performed at ambient pressure and temperature. Third, since electrochemical oxidation is coupled with electrochemical reduction, electrons obtained at the anode from HMF oxidation can be simultaneously used for a valuable reduction reaction at the cathode, which can significantly increase the worth of the electrochemical approach.

One embodiment of an electrochemical cell comprises a copper-based anode in an anode electrolyte solution comprising a solvent and an aromatic alcohol, such as HMF. A cathode in a cathode electrolyte solution is in electrical communication with the anode. The electrolyte solvents in the anode and cathode electrolyte solutions can be the same or different and the electrolyte solutions can be aqueous or non-aqueous. The operation of the electrochemical cell to oxidize HMF to FDCA is described in detail in the Example. A more general description of the electrochemical oxidation of an aromatic alcohol in an aqueous electrolyte solution is provided here. To operate the electrochemical cell, a voltage source is used to apply an anode potential to the copper-based anode and a potential difference is created between the anode and the cathode. Driven by this potential difference, electrons flow from the anode to the cathode through an external wire. The electrons at the surface of the cathode undergo reduction reactions with species contained in the cathode electrolyte solution, while oxidation reactions occur at the anode.

Aromatic compounds, other than aromatic compounds with an aromatic ring having an alcohol substituent, can be present in the initial anode electrolyte solution. However, generally, the aromatic alcohols that are initially present (i.e., that are present before the onset of the electrochemical oxidation) will be the predominant aromatic compounds present in the starting electrolyte solution. Thus, in some embodiments of the electrochemical cells aromatic alcohols make up at least 50 mol. % of aromatic compounds that are initially present in the anode electrolyte solution. This includes embodiments in which aromatic alcohols make up at least 70 mol. %, at least 80 mol. %, at least 90 mol. %, at least 95 mol. %, and at least 99 mol. % of the aromatic compounds present in the initial anode electrolyte solution.

In another embodiment the electrochemical cell comprises a copper-based anode in an anode electrolyte solution comprising a solvent and furfural ($C_5H_4O_2$). A cathode in a cathode electrolyte solution is in electrical communication with the anode. The electrolyte solvents in the anode and cathode electrolyte solutions can be the same or different and the electrolyte solutions can be aqueous or non-aqueous. To operate the electrochemical cell, a voltage source is used to apply an anode potential to the copper-based anode and a potential difference is created between the anode and the cathode. Driven by this potential difference, electrons flow from the anode to the cathode through an external wire. The electrons at the surface of the cathode undergo reduction reactions with species contained in the cathode electrolyte solution, while oxidation reactions occur at the anode.

The copper-based anodes are characterized in that their surfaces are at least partially comprised of copper. The use of copper-based anodes is advantageous because copper is an inexpensive transition metal that forms oxides and hydroxides that are not known to be catalytic for water oxidation, which is a major reaction competing with aromatic alcohol and aromatic aldehyde oxidation in aqueous solutions. Therefore, the use of copper-based anodes may achieve the oxidation of aromatic alcohols and aldehydes to aromatic carboxylic acids with a high Faradaic efficiency (FE).

In some embodiments of the copper-based anodes, the copper is present in the form of copper-containing compounds, such as a copper oxides and/or copper hydroxides that are catalytic for the electrochemical oxidation of the aromatic alcohols or furfural. Copper oxides and copper hydroxides that may be present at the surface of the anode include CuO, $Cu_2O$, $Cu_2O_3$, $Cu(OH)_2$, and combinations thereof.

In some embodiments of the copper-based anodes, the bulk of the anode is comprised of copper oxides, copper hydroxides, or a combination thereof, while in other embodiments the copper oxides, copper hydroxides, or the combination thereof are present only in a surface layer over the bulk of the anode. For example, the bulk of the anode can comprise copper metal and/or copper compounds that undergo oxidation to form surface copper oxides and/or copper hydroxides under an applied bias in an oxygen-containing environment, such as in the aqueous anode electrolyte solution of an electrochemical cell. The copper metal or copper compounds can be oxidized prior to their incorporation into the electrochemical cell, or can be oxidized in the electrochemical cell by the anodic bias used for the oxidation of the aromatic reactant. Examples of copper compounds that can be oxidized to form copper oxides and/or copper hydroxides include copper sulfides, copper selenides, copper tellurides, and copper phosphides. Copper-based anodes formed from these compounds may retain their respective non-metals (i.e., sulfur, selenium, tellurium, and phosphorous) in the bulk and at a portion of the anode surface. Other elements may also be included in the bulk and/or at the surface of the anodes. For example, metal (including noble metal) and/or non-metal elements that enhance the catalytic properties of the anode can be incorporated into the anodes. These elements include, nickel, cobalt, tin, silver, gold, indium, nitrogen, and halogens. These elements may be present as minor components that serve as promoters.

The copper-based anodes can have a variety of morphologies. For example, they can be planar, substantially planar, or nanostructured and they can be porous or non-porous. A high surface area is generally desirable, but is not absolutely necessary. Examples of suitable anode structures include copper or copper-containing foils, foams, and meshes having surfaces that are oxidized to copper oxides and/or hydroxides. The nanostructured anodes are characterized by one or more nanoscale surface features or dimensions, where a nanoscale surface feature or dimension has a size of no greater than 1000 nm and, in some cases, no greater than 100 nm. Nanostructured anodes include anodes formed from sintered nanoparticles or solution-grown nanoparticles and nanocrystalline electrodes prepared by electrodeposition, of the type described in the Example.

In some embodiments of the electrochemical cells, the cathode reaction is the reduction of water to $H_2$. However, other cathode reactions are possible, including the reduction of carbon dioxide to form carbon-based fuels, such as methanol or methane, or the reduction of organic molecules to form more valuable organic chemicals. A variety of materials can be used for the cathode, depending on the reduction reaction that is being carried out. For example, metal cathodes, including noble metal cathodes, such as platinum, can be used.

The electrochemical oxidation of the aromatic alcohols can be carried out in electrolyte solutions at relatively low pH and still provide a high product yield. This is advantageous for aromatic compounds, such as HMF, that are unstable in high pH environments. For example, using the present cells and methods, electrochemical oxidations can be carried out at a pH of 13 or lower. This includes embodiments of the cells and methods in which oxidation is carried out at a pH of 12 or lower. The anode electrolyte solutions may include a buffer to maintain a given pH.

The electrochemical oxidation of the aromatic alcohols can be carried out substantially completely to provide products at a high alcohol conversion and product yield. For example, aromatic alcohols, such as HMF, can be electrochemically oxidized with conversion of at least 90%, at least 95%, or even at least 99%. Aromatic alcohols, such as HMF, can be converted into aromatic carboxylic acids, such as FDCA, with product yields of at least 75%, at least 80%, at least 85%, at least 90%, and at least 95%.

The aromatic alcohol conversion (%) and the yield (%) of the oxidation products are calculated using the following equations:

$$\text{Aromatic alcohol conversion (\%)} = \frac{\text{mol. of aromatic alcohol consumed}}{\text{mol. of initial aromatic alcohol}} \times 100\%;$$

and $$\text{Yield of product (\%)} = \frac{\text{mol. of product formed}}{\text{mol. of initial aromatic alcohol}} \times 100\%.$$

The electrochemical oxidations can also be carried out with high Faradaic efficiencies (FEs). For electrochemical alcohol oxidation, achieving a high FE is as critical as achieving a high yield. Even if 100% yield of the product is achieved, if it is achieved with a low FE, the conversion process must consume significantly more charges than the stoichiometric amount of charge, increasing the electrical energy consumption and the production cost of the product. Using the present methods, aromatic alcohols, such as HMF, can be converted into aromatic carboxylic acids, such as FDCA, with an FE of at least 75%, at least 80%, at least 85%, at least 90%, and at least 95%.

The FE of the aromatic alcohol oxidation is calculated using the following equation:

$$FE = \frac{\text{charge used to produce product}}{\text{total charge used}} \times 100\%.$$

For electrochemical production of FDCA, developing a catalyst that can achieve a high FE as well as a high yield is critical. Even if 100% yield of FDCA is achieved, if it is achieved with a low FE, the conversion process consumes significantly more charges than the stoichiometric amount of change, increasing the electrical energy consumption and the production cost of FDCA.

EXAMPLE 1

In this example, the catalytic performance of copper as a catalytic anode for HMF oxidation to FDCA is reported. The anodes used in this example were plain bulk copper anodes, which have dense and featureless surfaces. The copper anodes are shown to be able to serve as a highly efficient catalytic anode for HMF oxidation to FDCA.

The plain copper electrodes were prepared by electrodeposition. A two-electrode setup composed of two Cu plates (i.e., thick copper foils) as the working electrode (WE) and counter (CE) electrode was used for deposition in an undivided cell. An aqueous solution containing 0.1 M $CuSO_4.5H_2O$ and 0.6 M $H_2SO_4$ was used as a plating solution. Cathodic deposition ($Cu^{2+}+2e^{-}\rightarrow Cu$, $E^{o}=0.34$ V vs. SHE) was carried out galvanostatically at a current density of −60 mA/cm$^2$ for 10 min.

Figures 2A, 2B, 2C:
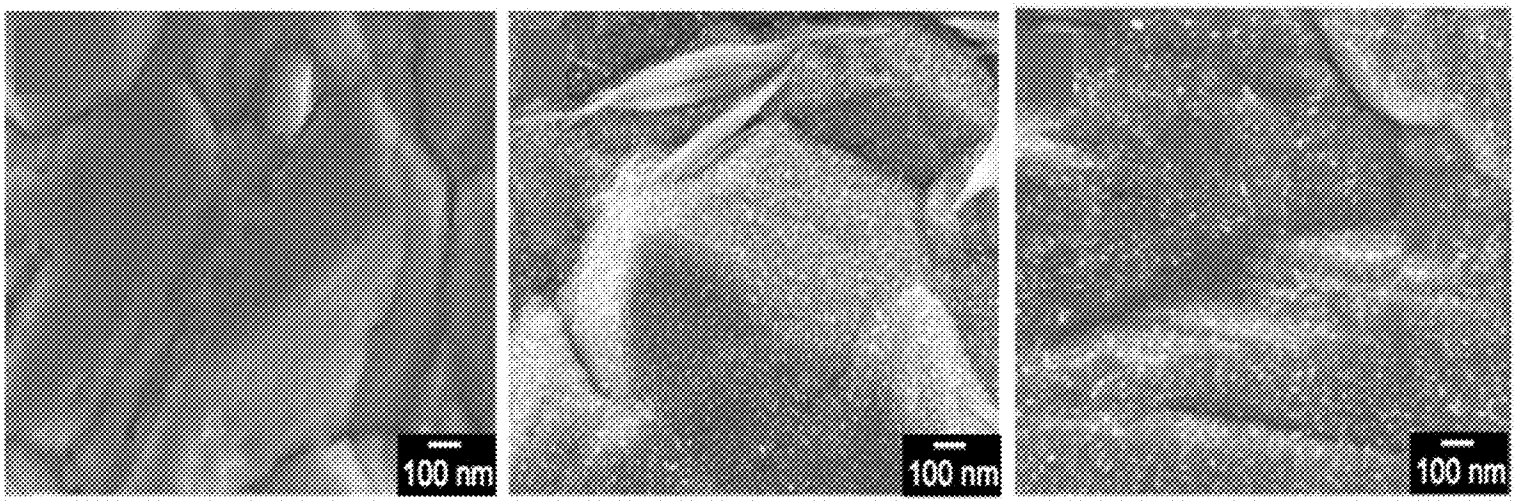
FIG. 2A is an SEM image showing the surface of a plain copper electrode as-prepared.
FIG. 2B is an SEM image showing the surface of a plain copper electrode after electrochemical oxidation.
FIG. 2C is an SEM image showing the surface of a plain copper electrode after HMF oxidation.

Under the anodic bias required for HMF oxidation the surface of the copper electrode would not remain as copper metal. Therefore, electrochemical oxidation of the copper electrode was first performed before carrying out HMF oxidation. Electrochemical oxidation was achieved by sweeping the potential from the open circuit potential to 1.97 V vs RHE (1.0 V vs Ag/AgCl) in a 0.1 M KOH solution (pH 13) at a scan rate of 10 mV s$^{-1}$. SEM images of a plain copper electrode before and after electrochemical oxidation are shown in FIGS. 2A and 2B. After electrochemical oxidation, the surface became roughened due to the conversion of copper to its oxidized phases. In general, the Cu surface was first oxidized to $Cu_2O$ and then CuO or $Cu(OH)_2$. A few ribbon-shaped features shown in FIG. 2B were mainly $Cu(OH)_2$, which was formed due to the direct anodic dissolution of copper as $Cu(OH)_4^{2-}$ at locations where an initially formed $Cu_2O$ passivation layer was imperfect. As $Cu(OH)_4^{2-}$ becomes supersaturated, it can precipitate and grow as $Cu(OH)_2$, part of which can go through dehydration to form CuO.

Figure 3A:
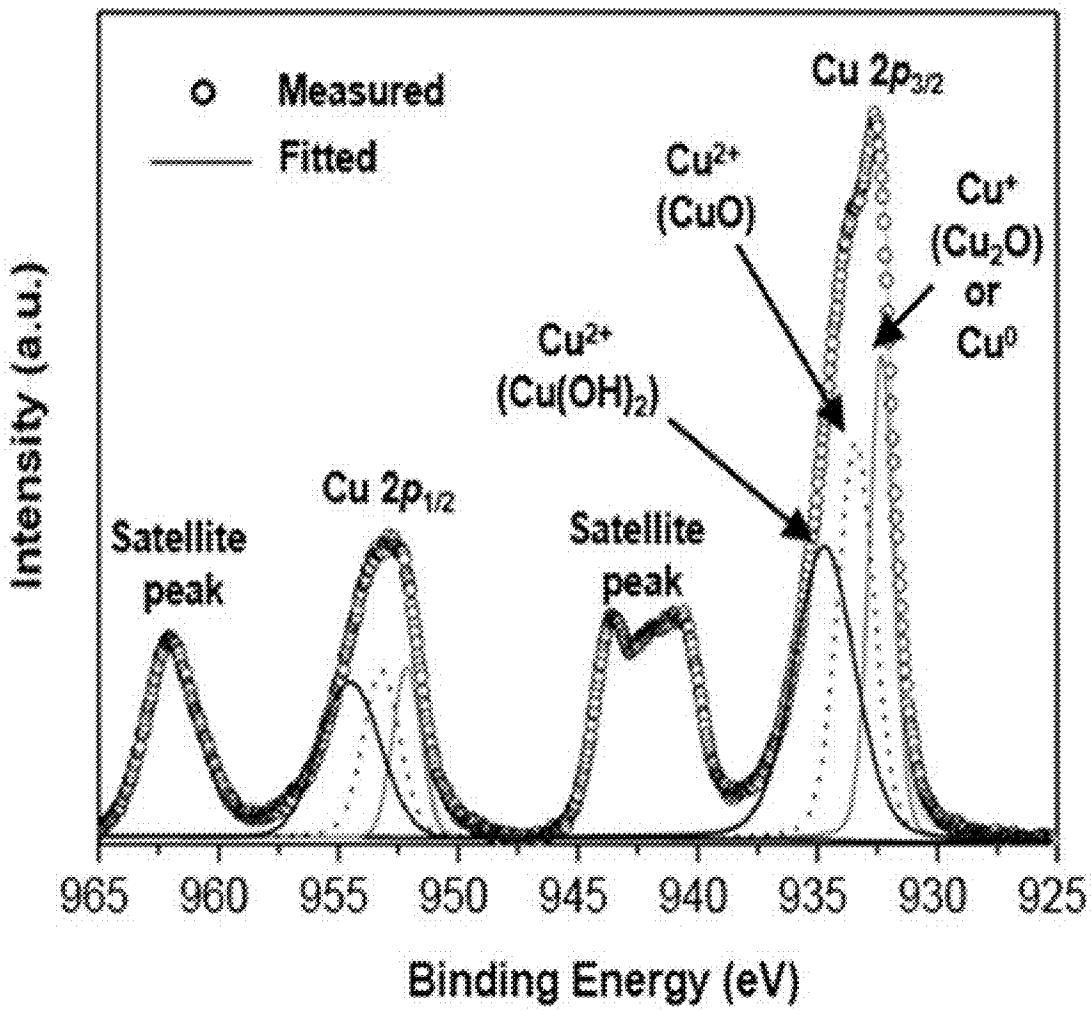
FIG. 3A shows XPS spectra of a plain bulk copper electrode after electrochemical oxidation.

The surface composition of the oxidized copper electrode was investigated by analyzing a Cu 2p peak obtained by X-ray photoelectron spectroscopy (XPS). Notably, the XPS result cannot serve as a comprehensive composition analysis of the surface layer because it shows the composition of the surface layer only within the penetration depth of the X-rays used for the measurement. The curve fitting result showed that a mixture of $Cu_2O$, CuO, and $Cu(OH)_2$ were present on the surface (FIG. 3A). Note that the Cu 2p peaks of $Cu^{+}$ and $Cu^{0}$ cannot be differentiated. Therefore, the $Cu_2O$ peaks may contain the $Cu^{0}$ peaks from the copper under the surface layer.

Figure 4:
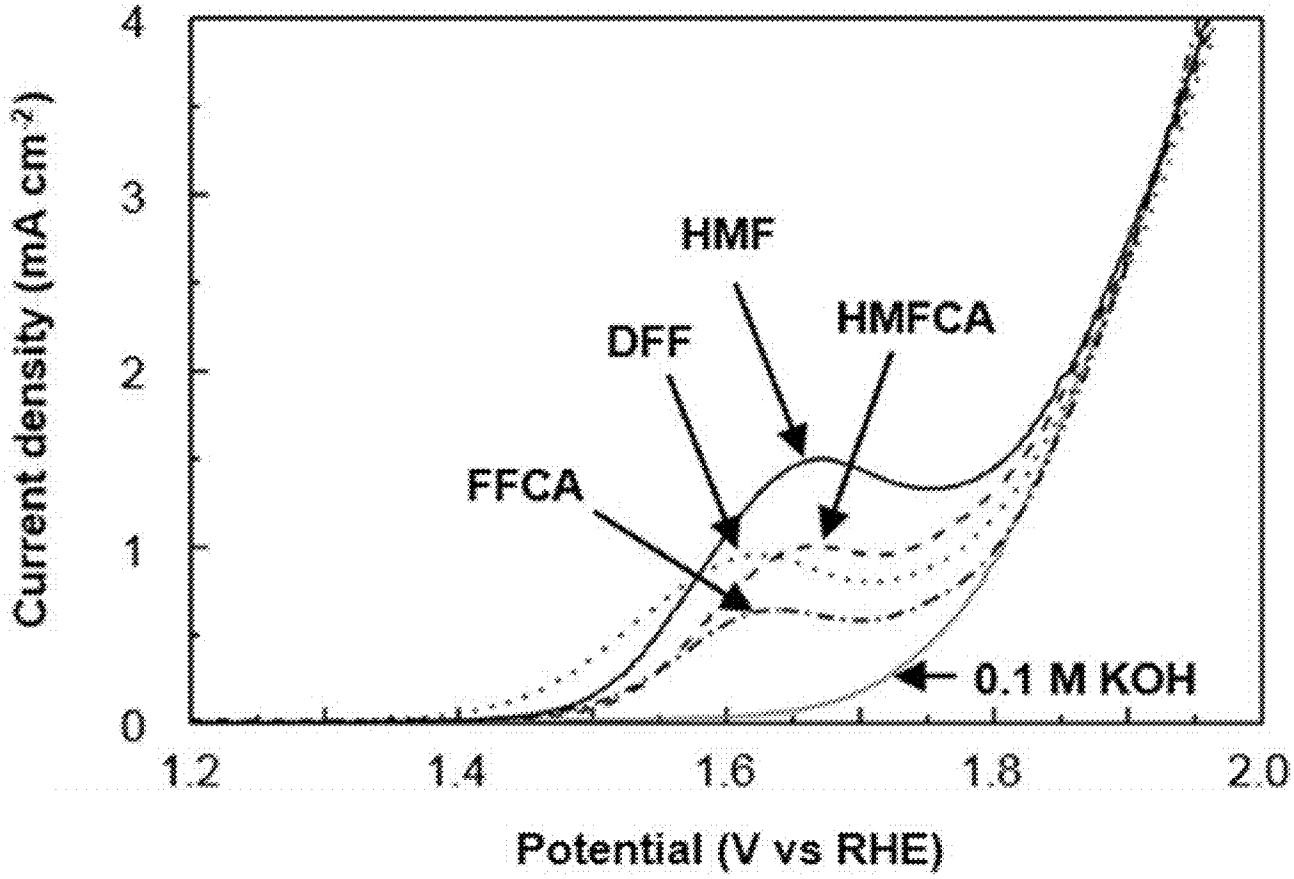
FIG. 4 depicts LSVs of the plain copper electrode obtained in a 0.1 M KOH (pH 13) without any substrates (gray solid) and with 5 mM HMF (black solid), 5 mM DFF (black dotted), 5 mM HMFCA (black dashed), and 5 mM FFCA (black dash-dot) at a scan rate of 10 mV $s^{-1}$.

The catalytic ability of the oxidized plain copper electrode was first investigated using linear sweep voltammograms (LSVs) with and without 5 mM HMF in a 0.1 M KOH solution (pH 13) at a scan rate of 10 mV s$^{-1}$ (FIG. 4). The only oxidation wave shown in the LSV obtained without HMF was due to water oxidation that initiated around 1.5 V vs. RHE (FIG. 3A, gray solid line). The oxide and hydroxide layer formed during the electrochemical oxidation of the copper electrode completely passivated the copper surface, preventing further oxidation of copper. Therefore, when the pre-oxidized copper electrodes were used for oxidation reactions of water and HMF, the oxidation current due to the oxidation of copper was no longer present.

When the LSV was repeated in a 0.1 M KOH solution (pH 13) containing 5 mM HMF (FIG. 4, black solid line), the onset potential for anodic current shifted from 1.5 V to 1.4 V vs. RHE and a well-defined oxidation peak due to HMF oxidation appeared before water oxidation. This indicated that HMF oxidation was more favorable than water oxidation on the plain copper electrode.

LSVs were also obtained in a solution containing each of 5 mM DFF, 5 mM HMFCA, and 5 mM FFCA (FIG. 4). All of them showed an earlier (less positive) anodic current onset potential than that for water oxidation, demonstrating that the full conversion of HMF to FDCA can be achieved without inducing water oxidation using a plain copper electrode.

Constant potential oxidation of HMF to FDCA was carried out at 1.69 V vs. RHE (0.72 V vs Ag/AgCl) using a cell divided with a glass frit. The WE compartment (anolyte) contained 14 mL of a 0.1 M KOH solution containing 5 mM HMF while the CE compartment (catholyte) contained 14 mL of a 0.1 M KOH solution. The anode, cathode, and the overall reactions are summarized below.

$$\text{Anode reaction: } HMF+6OH^{-}\rightarrow FDCA+4H_2O+6e^{-} \quad (1)$$

$$\text{Cathode reaction: } 6H_2O+6e^{-}\rightarrow 3H_2+6OH^{-} \quad (2)$$

$$\text{Overall reaction: } HMF+2H_2O\rightarrow FDCA+3H_2 \quad (3)$$

Figure 5:
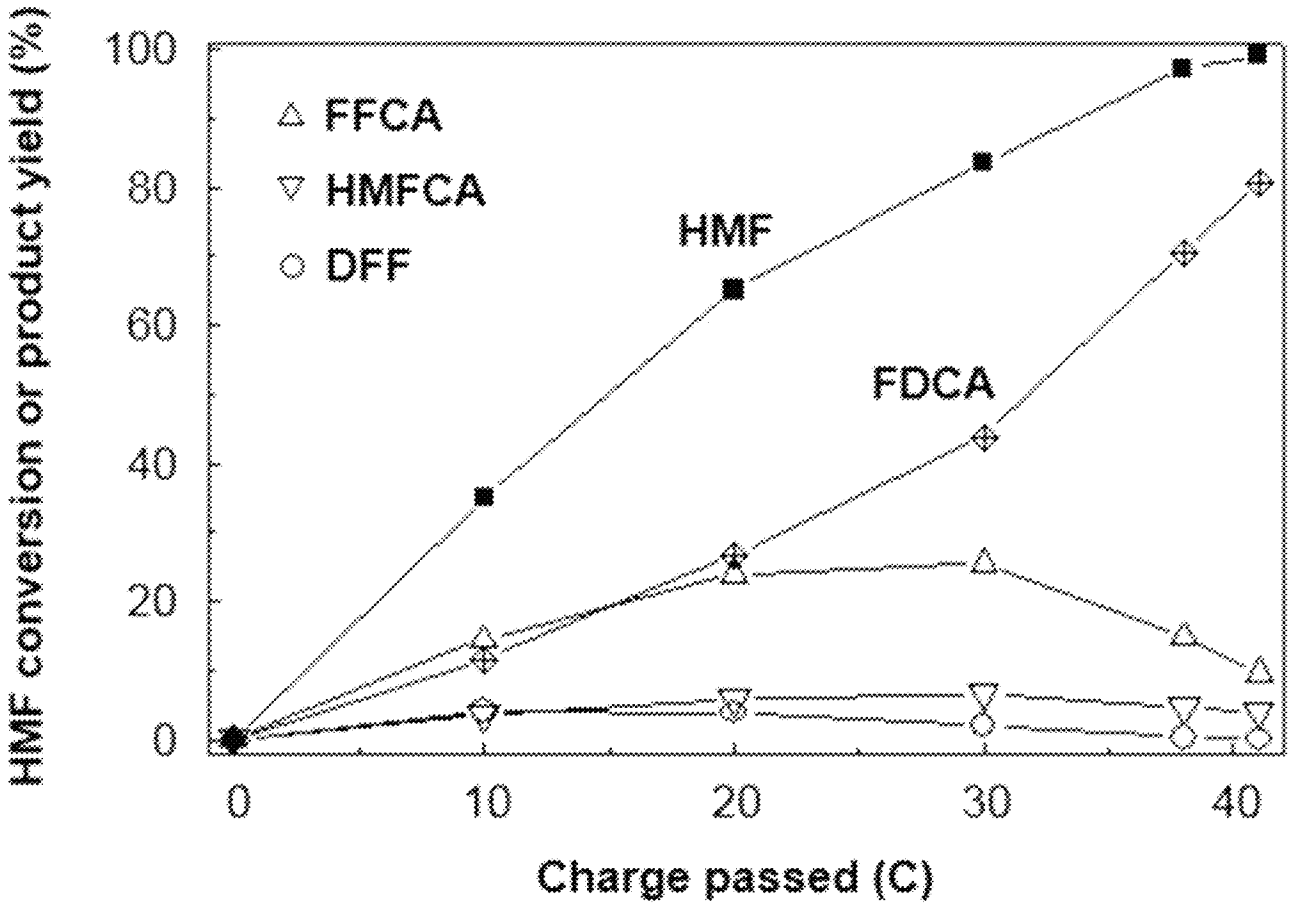
FIG. 5 depicts the conversion of HMF (%) and yield (%) of its oxidation products during the electrochemical oxidation of HMF at 1.69 V versus RHE (0.72 V versus Ag/AgCl) in a 0.1 M KOH solution containing 5 mM HMF.

The concentration changes of HMF and its oxidation products in the anolyte were monitored during the HMF oxidation using high-performance liquid chromatography (HPLC) (FIG. 5). The HMF conversion (%) and the yield (%) of the oxidation products were calculated using the following reactions.

$$HMF\ \text{conversion}(\%) = \frac{\text{mol. of } HMF \text{ consumed}}{\text{mol. of initial } HMF} \times 100\% \quad (4)$$

$$\text{Yield of product}(\%) = \frac{\text{mol. of product formed}}{\text{mol. of initial } HMF} \times 100\% \quad (5)$$

The stoichiometric amount of charge to completely convert 14 mM of a 5 mM HMF solution to FDCA is 40.5 C. At 41 C, HMF conversion was 99.1%, the FDCA yield was 80.8%, and the FE for FDCA production was 79.9%.

$$FE(\%) \text{ for } FDCA \text{ production} = \frac{\text{mol. of } FDCA \text{ formed}}{\text{mol. of total electrons passed}/6} \times 100\% \quad (6)$$

Figure 3B:
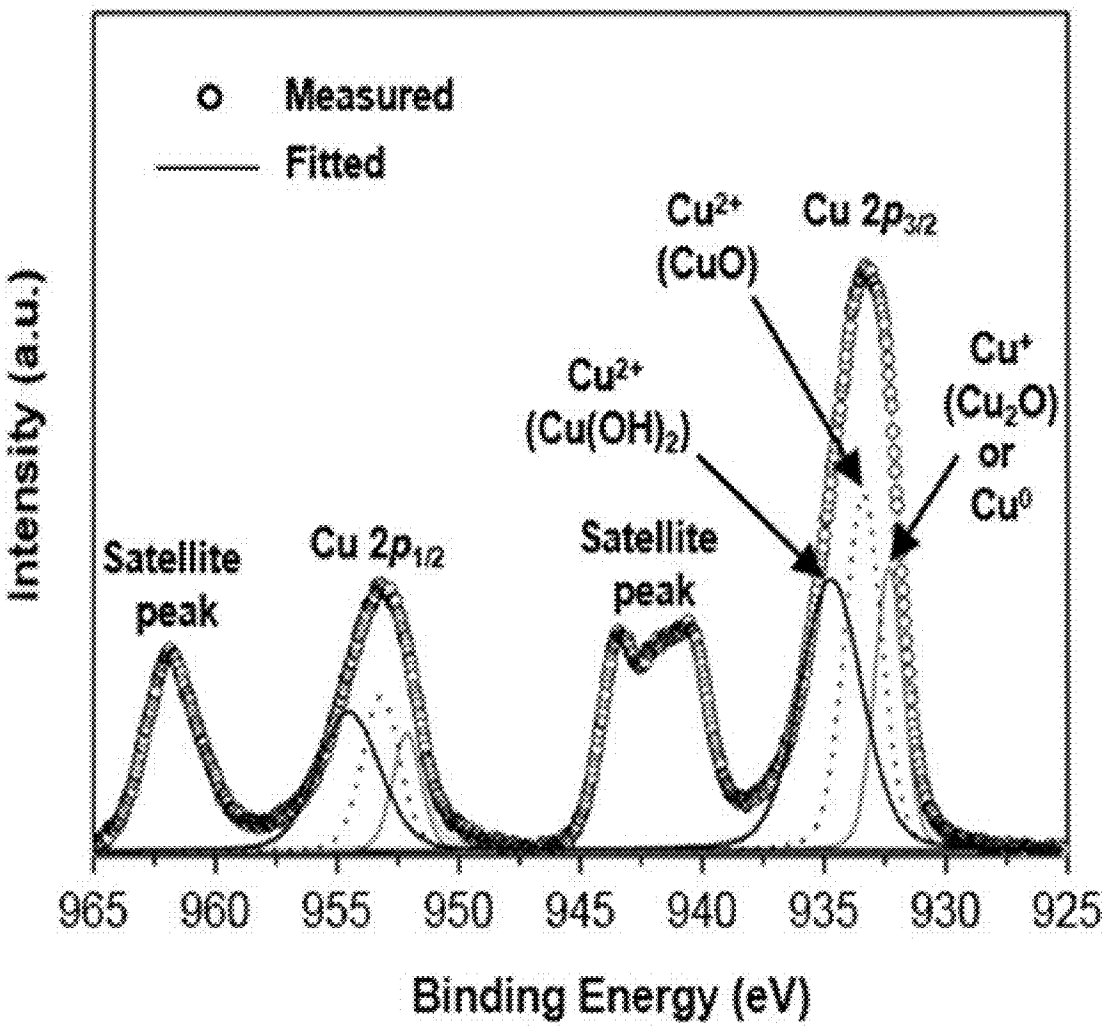
FIG. 3B shows XPS spectra of the plain bulk copper electrode after constant potential oxidation of HMF at 1.69 V vs. RHE.

After the electrolysis, the surface of the plain copper electrode was re-examined. The SEM (FIG. 2C) showed no evident changes other than the loss of ribbon-shaped features present in FIG. 2B. According to the XPS result (FIG. 3B), the surface was still composed of a mixture of $Cu_2O$, CuO, and $Cu(OH)_2$, but the amount of $Cu^{2+}$ species (CuO and $Cu(OH)_2$) increased slightly.

Commercially available bulk copper electrodes in the form of plate, foil, mesh, and foam or other copper electrodes that have dense and featureless surfaces would be expected to show performances similar to those demonstrated by the plain bulk copper electrode.

EXAMPLE 2

This example reports the catalytic performance of nanocrystalline copper as a catalytic anode for HMF oxidation to FDCA. The nanocrystalline copper is a high surface area foam that achieves even more efficient FDCA production than plain bulk copper.

Figure 6B:
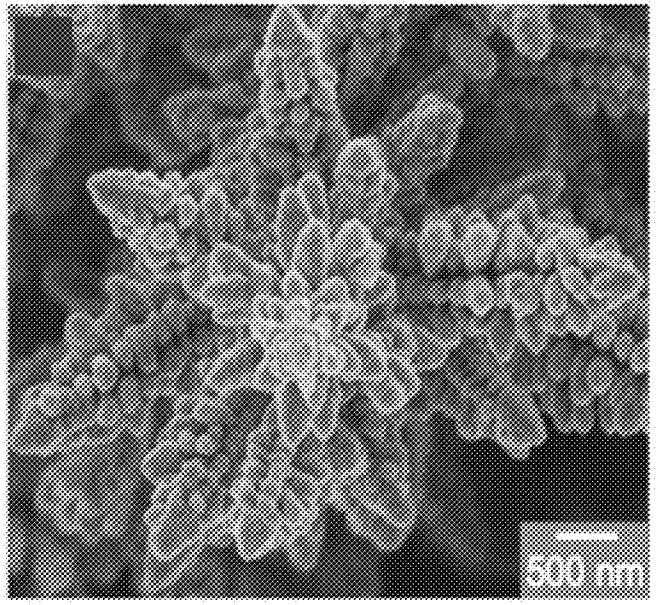
FIG. 6B is a high magnification SEM image of an NCF electrode.
Figure 6A:
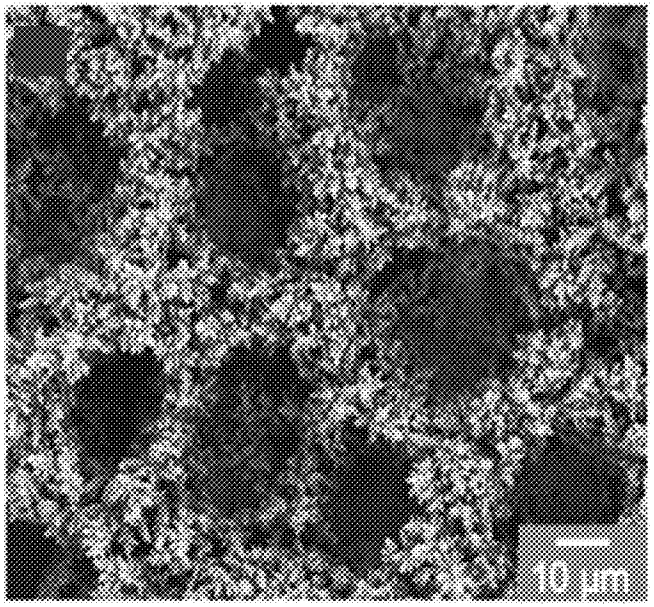
FIG. 6A is a low magnification SEM image of an NCF electrode.

The nanocrystalline copper electrodes used in this example were prepared by electrodeposition. A two-electrode setup composed of the aforementioned plain bulk copper electrode as the WE and a Cu plate as the CE was used for deposition in an undivided cell. An aqueous solution containing 0.2 M $CuSO_4.5H_2O$ and 0.7 M $H_2SO_4$ was used as a plating solution. Cathodic deposition ($Cu^{2+}+2e^{-}\rightarrow Cu$, $E^{o}=0.34$ V vs. SHE) was carried out galvanostatically at a current density of −2 A/cm$^2$ for 5 s. This level of deposition current density could induce water reduction to $H_2$ as well as copper deposition. In this case, the $H_2$ bubbles formed on the WE served as an in-situ generated template to deposit microporous Cu electrodes having a foam structure (FIG. 6A). The high magnification SEM images show that the wall of the foam structure was composed of nanoscale corncob-like dendrites, contributing further to the increase in surface area of the electrode (FIG. 6B). This electrode will be denoted as a nanocrystalline copper foam (NCF) electrode hereafter.

Figures 7A, 7B, 7C:
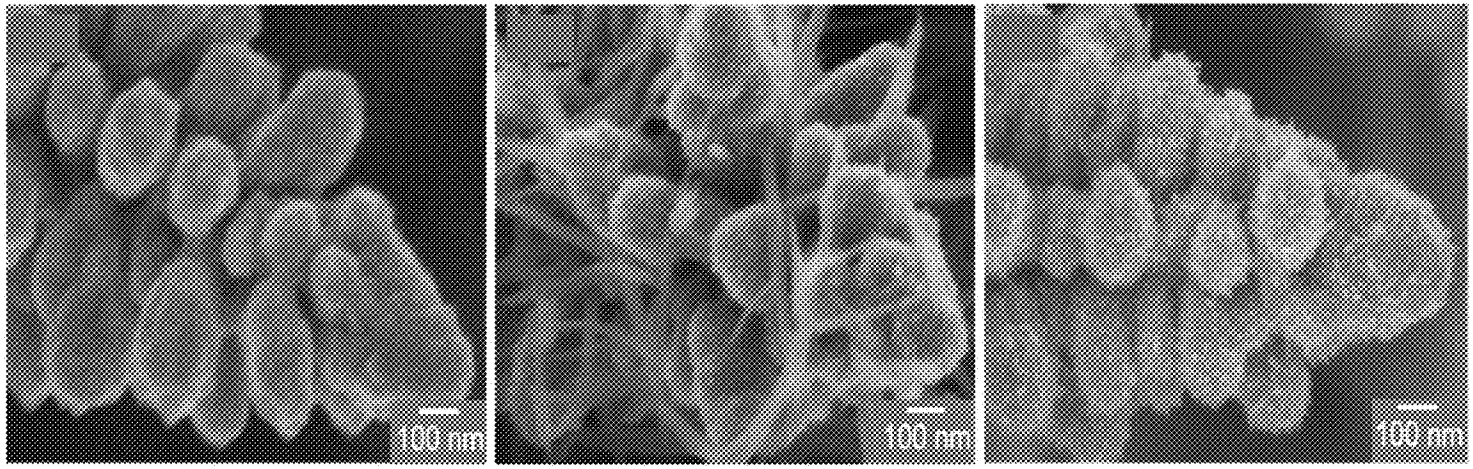
FIG. 7A shows a high magnification SEM image of an NCF electrode as-prepared.
FIG. 7B shows a high magnification SEM image of an NCF electrode after electrochemical oxidation.
FIG. 7C shows a high magnification SEM image of an NCF electrode after HMF oxidation.

Before testing HMF oxidation, the NCF electrode was electrochemically oxidized using the same method described in Example 1 (i.e. sweeping the potential from the open circuit potential to 1.97 V vs RHE (1.0 V vs Ag/AgCl). Comparing the SEM images of the NCF electrode before and after electrochemical oxidation, it is clear that the surface of each Cu dendrite crystal became roughened, with small spike-like features covering the surface. Also, between the dendritic particles, plentiful long ribbon-shaped features grew (FIGS. 7A and 7B). Compared to the oxidized plain copper electrode (FIG. 2B), the formation of oxidized phases was more pronounced on the NCF surface. This is because the high curvature surface of copper nanocrystals of the NCF electrode, which possess copper atoms with a coordination environment that is less rigid than those of copper atoms in the bulk structure, can facilitate the formation of more oxide and hydroxide phases.

Figure 8A:
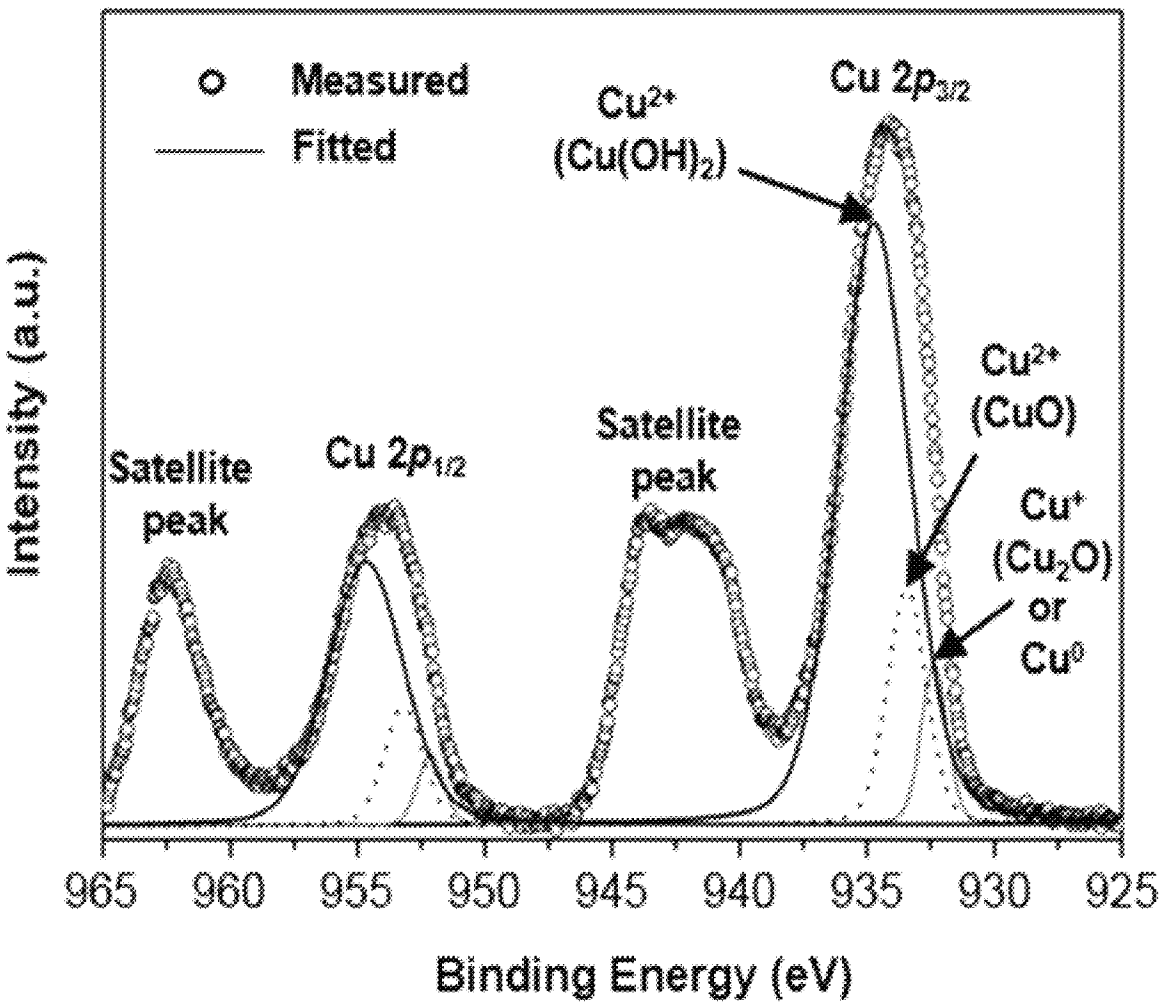
FIG. 8A shows XPS spectra of an NCF electrode after electrochemical oxidation.

The XPS study showed that the oxidized NCF electrode surface was also composed of $Cu_2O$, CuO, and $Cu(OH)_2$ (FIG. 8A). Compared to the composition of the oxidized plain copper electrode, the oxidized NCF electrode contained a significantly higher $Cu(OH)_2$ partly due to the abundance of the ribbon-shaped features, which are mostly $Cu(OH)_2$.

Figure 9:
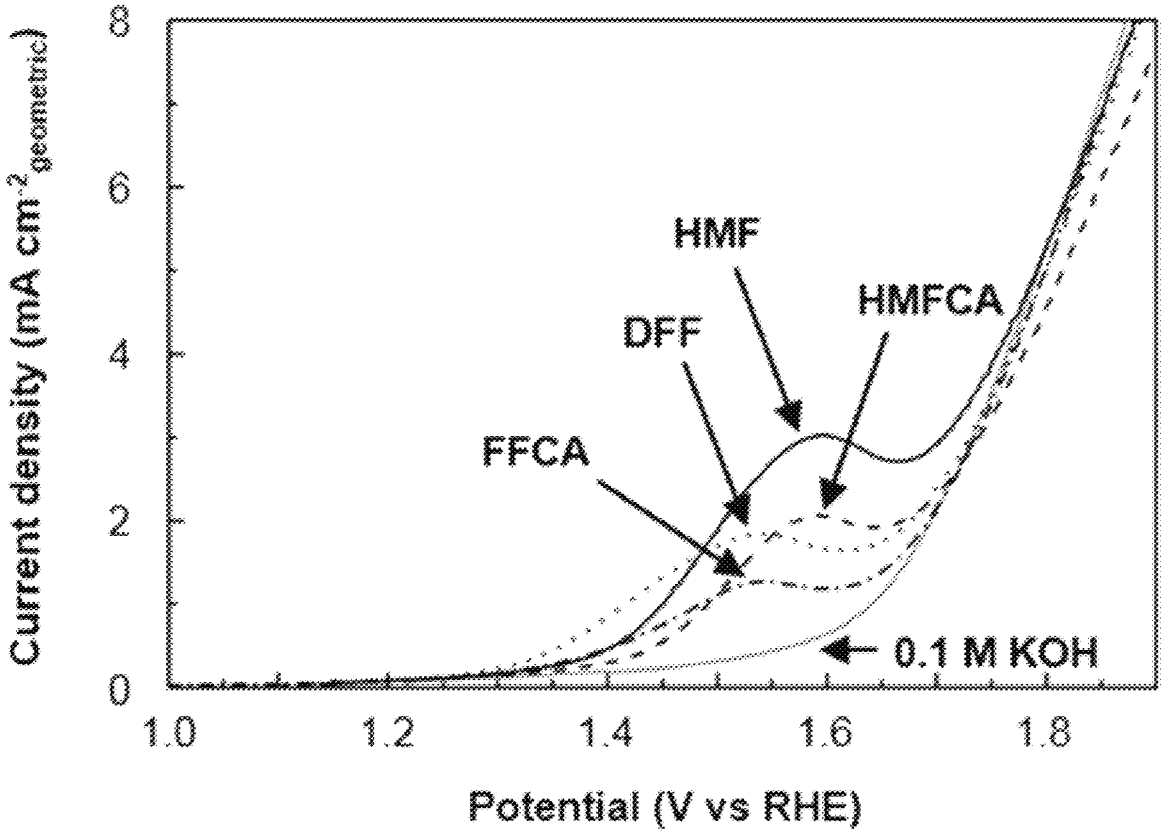
FIG. 9 depicts LSVs of the NCF electrode obtained in a 0.1 M KOH (pH 13) without any substrates (gray solid) and with 5 mM HMF (black solid), 5 mM DFF (black dotted), 5 mM HMFCA (black dashed), and 5 mM FFCA (black dash-dot) at a scan rate of 10 mV $s^{-1}$.

The catalytic ability of the oxidized NCF electrode was investigated using LSVs obtained with and without 5 mM HMF in a 0.1 M KOH solution (pH 13) at a scan rate of 10 mV $s^{-1}$ (FIG. 9). The results show a well-defined HMF oxidation peak before water oxidation, confirming that HMF oxidation is more favorable than water oxidation on the NCF electrode. LSVs were also performed with a solution containing each of 5 mM DFF, 5 mM HMFCA, and 5 mM FFCA. Compared to the LSVs obtained with the plain bulk electrode, the anodic current onset potentials for HMF, DFF, HMFCA, and FFCA oxidation were all shifted to the left by ~100 mV. This is highly favorable because it means that FDCA production can be achieved with less potential input, which decreases the total electrical energy required for FDCA production. Further, the current densities observed in the LSVs of the NSF electrode were significantly higher than those obtained in the LSVs of the plain copper electrode due to the high surface area gained by the nanocrystalline foam structure.

Figure 10:
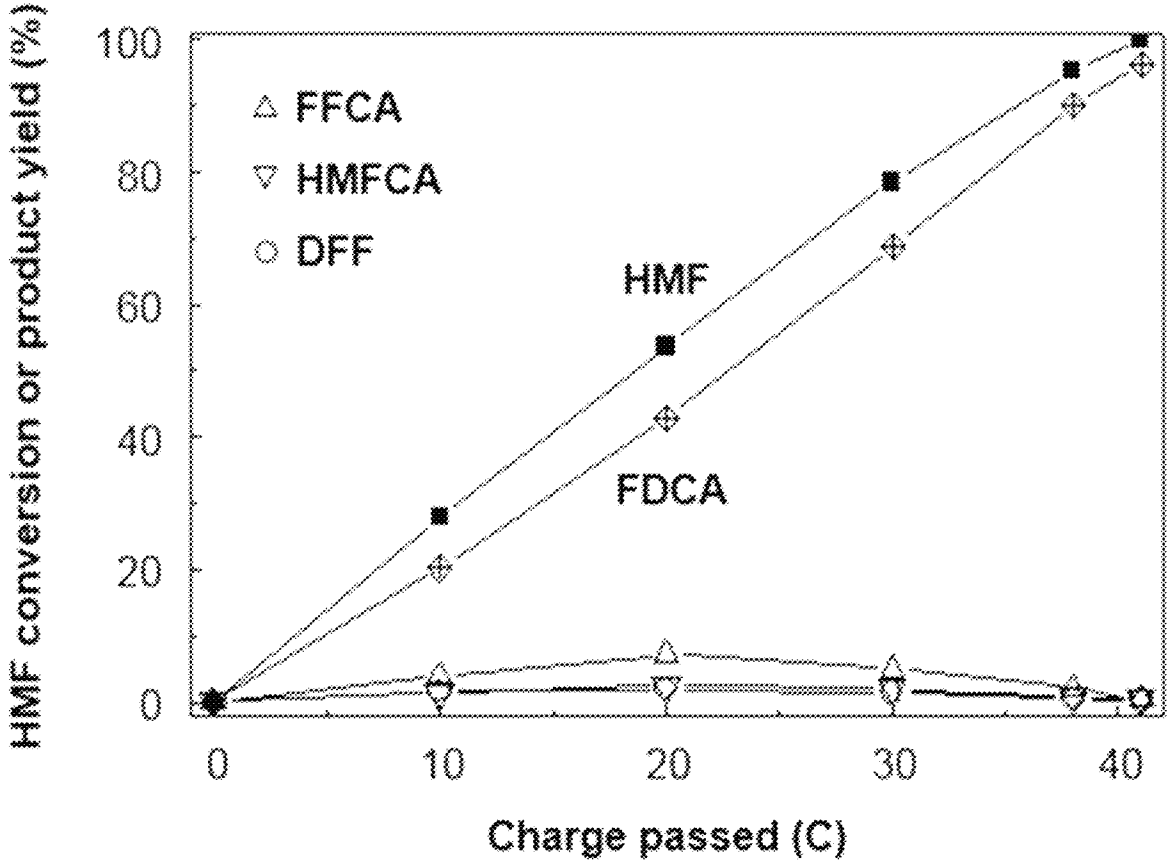
FIG. 10 depicts the conversion of HMF (%) and yield (%) of its oxidation products during the electrochemical oxidation of HMF using an NCF electrode at 1.62 V versus RHE (0.65 V versus Ag/AgCl) in a 0.1 M KOH solution containing 5 mM HMF.

Constant potential oxidation of HMF to FDCA was carried out as described above, with 1.62 V vs RHE applied to the WE. The HMF conversion and the yields of the oxidation products are shown in FIG. 10.

Figure 8B:
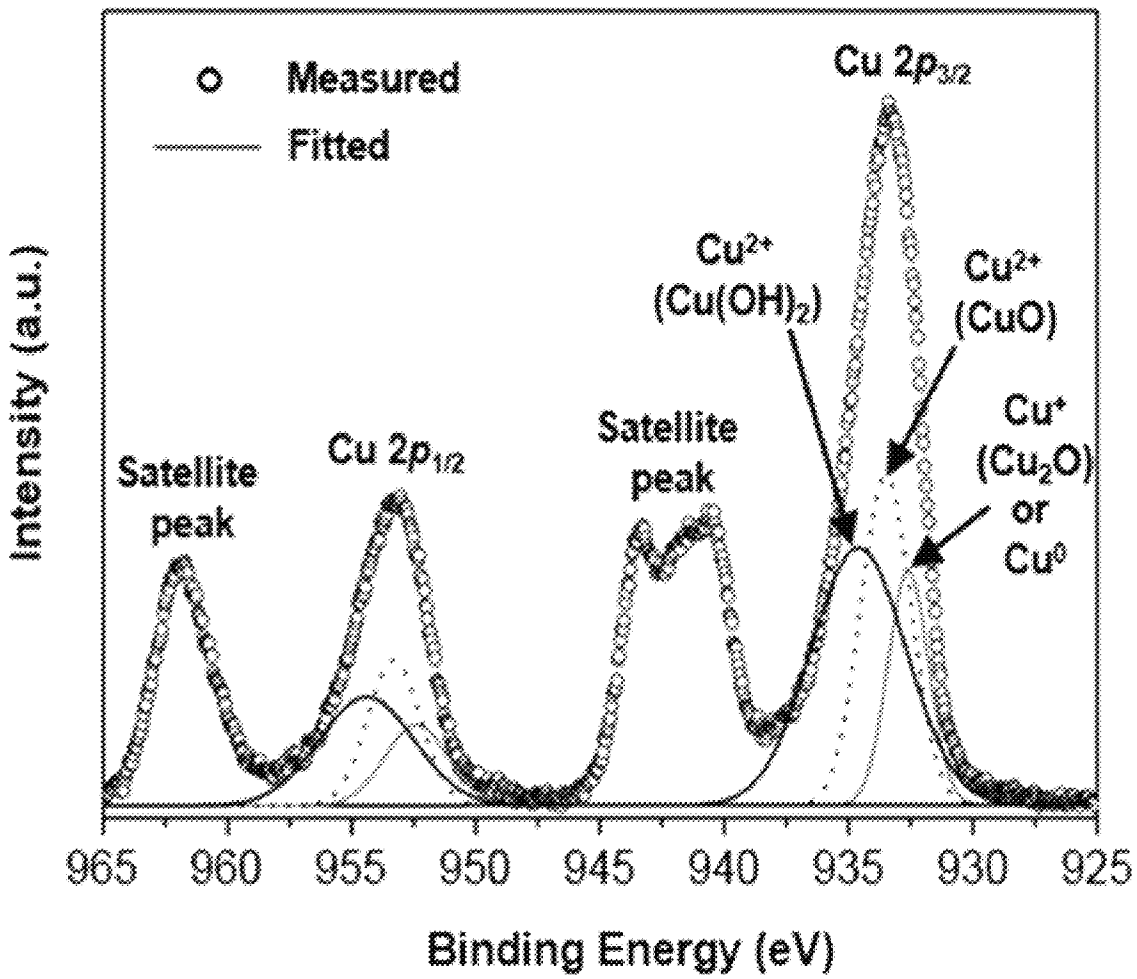
FIG. 8B shows XPS spectra of the NCF electrode after constant potential oxidation of HMF at 1.62 V vs. RHE.
Figure 11:
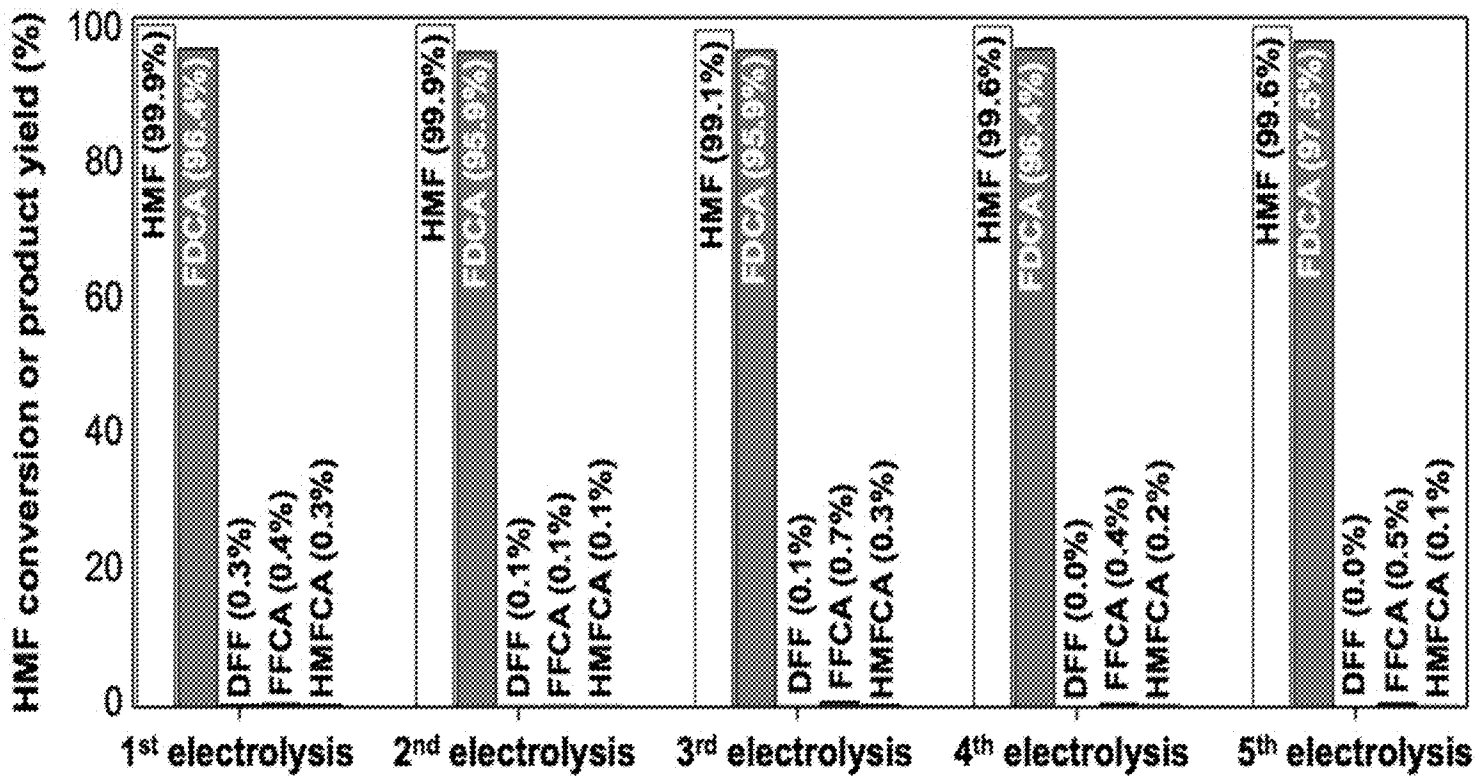
FIG. 11 depicts the HMF conversion and FDCA yield obtained by the NCF electrode for five consecutive uses.

The stoichiometric amount of charge to completely convert 14 mM of a 5 mM HMF solution to FDCA was 40.5 C. At 41 C, HMF conversion was 99.9%, FDCA yield was 96.4%, and the FE for FDCA production was 95.3%. The conversion performance achieved by the NCF electrode was remarkable. The conversion profiles (in particular, the profiles of HMF conversion, FFCA formation, and FDCA formation) achieved by the plain copper electrode (FIG. 5) and by the NCF electrodes (FIG. 10) were quite different. For the case of the plain copper electrode, a considerable accumulation of FFCA was observed, limiting FDCA production. This suggests that among the oxidation steps shown in FIG. 1, the oxidation of FFCA to FDCA is the slowest step for the plain copper electrode. However, in the case of the NCF electrode, FFCA accumulation was negligible and the conversion rate of HMF and the production rate of FDCA looked almost comparable. This suggests that the excellent performance of the NCF electrode was not simply due to the surface area increase. It seems that the oxide and hydroxide phases formed on the copper nanocrystals that compose the NCF electrode were intrinsically more catalytic for the conversion of FFCA to FDCA. After the electrolysis, the surface of the NCF electrode was reexamined. The SEM showed no evident changes other than the loss of ribbon-shaped features (FIG. 7C). The XPS result showed that the surface of the NCF electrode was still composed of a mixture of $Cu_2O$, CuO, and $Cu(OH)_2$; however, the amount of $Cu(OH)_2$ decreased (FIG. 8B). This is most likely due to the loss of the ribbon-shaped features, which are mostly $Cu(OH)_2$. However, $Cu(OH)_2$ was still the majority phase, suggesting that the tiny spike-like features covering the dendritic copper crystals are also mostly $Cu(OH)_2$. The ribbon-shaped features are not critical for the excellent catalytic ability observed with the NCF electrode. When the NCF electrode that lost the ribbon-shaped features was re-used for HMF oxidation, the same HMF conversion and FDCA yield were obtained repeatedly (FIG. 11).

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. An electrochemical cell comprising:

a copper anode in an anode electrolyte solution, the anode electrolyte solution having a pH of at least 12 and no greater than 13 and comprising 5-hydroxymethylfurfural, wherein the 5-hydroxymethylfurfural makes up at least 50 mol. % of all aromatic compounds in the anode electrolyte solution; and a cathode in a cathode electrolyte solution.

2. The electrochemical cell of claim 1, wherein the anode comprises copper metal.

3. The electrochemical cell of claim 1, wherein the anode comprises a copper compound.

4. The electrochemical cell of claim 1, wherein the anode comprises at least one non-metal element.

5. The electrochemical cell of claim 4, wherein the at least one additional non-metal element is oxygen, sulfur, selenium, tellurium, phosphorus, nitrogen, a halogen, or a combination of two or more thereof.

6. The electrochemical cell of claim 5, wherein the anode comprises sulfur, selenium, tellurium, nitrogen, a halogen, or a combination of two or more thereof.

7. The electrochemical cell of claim 1, wherein the 5-hydroxymethylfurfural makes up at least 70 mol. % of all aromatic compounds in the anode electrolyte solution.

8. The electrochemical cell of claim 1, wherein the anode further comprises nickel, tin, silver, indium, or a combination of two or more thereof.

9. An electrochemical cell comprising:

an anode comprising a copper sulfide, a copper selenide, a copper telluride, a copper phosphide, or a combination of two or more thereof in an anode electrolyte solution, the anode electrolyte solution having a pH of at least 12 and comprising 5-hydroxymethylfurfural, wherein the 5-hydroxymethylfurfural makes up at least 50 mol. % of all aromatic compounds in the anode electrolyte solution; and a cathode in a cathode electrolyte solution.

10. An electrochemical cell comprising:

an anode in an anode electrolyte solution, the anode comprising copper and at least one additional metal element, wherein the at least one additional metal element does not comprise cobalt, the anode electrolyte solution having a pH of at least 12 and comprising 5-hydroxymethylfurfural, wherein the 5-hydroxymethylfurfural makes up at least 50 mol. % of all aromatic compounds in the anode electrolyte solution; and a cathode in a cathode electrolyte solution.

11. The electrochemical cell of claim 10, wherein the at least one additional metal element is nickel, tin, silver, indium, or a combination of two or more thereof.

12. An electrochemical cell comprising:

an anode electrolyte solution having a pH of at least 12 and comprising 5-hydroxymethylfurfural, wherein the 5-hydroxymethylfurfural makes up at least 50 mol. % of all aromatic compounds in the anode electrolyte solution;

an anode in the anode electrolyte solution, the anode having a bulk and a surface, wherein both the bulk and the surface of the anode consist of copper oxides, copper hydroxides, or a combination thereof; and a cathode in a cathode electrolyte solution.

* * * * *